United States Patent [19]

Weihbold

[11] 4,098,497

[45] Jul. 4, 1978

[54] MEDIUM-CONDUIT-SYSTEM TO BE USED IN TILTABLE-METALLURGICAL-VESSEL-ARRANGEMENT

[75] Inventor: Heinz Weihbold, Linz, Austria

[73] Assignee: Vereinigte Osterreichische Eisen- und Stahlwerke - Alpine Montan Aktiengesellschaft, Vienna, Austria

[21] Appl. No.: 762,193

[22] Filed: Jan. 24, 1977

[30] Foreign Application Priority Data

Feb. 3, 1976 [AT] Austria ..... 727/76

[51] Int. Cl.[2] ..... C21C 5/42

[52] U.S. Cl. ..... 266/241; 266/245

[58] Field of Search ..... 266/218, 220–224, 266/241, 245, 246

[56] References Cited

U.S. PATENT DOCUMENTS 3,345,058 10/1967 Pere ..... 266/241

*Primary Examiner*—Gerald A. Dost

*Attorney, Agent, or Firm*—Burns, Doane, Swecker & Mathis

[57] ABSTRACT

A medium-conduit-system for use in a tiltable-metallurgical-vessel-arrangement of the type including a carrying ring for the vessel, tilting trunnions on the carrying ring and base-supported bearings for the tilting trunnions, wherein at least one of the tilting trunnions is hollow, has a first pipe in the hollow trunnion and a second pipe extending through the carrying ring changing the direction and connected by a flange connection with screws to the first pipe, the screws having extensions projecting to the outside of the vessel-arrangement, and a supply system is connected to the second pipe.

13 Claims, 4 Drawing Figures

FIG. 1
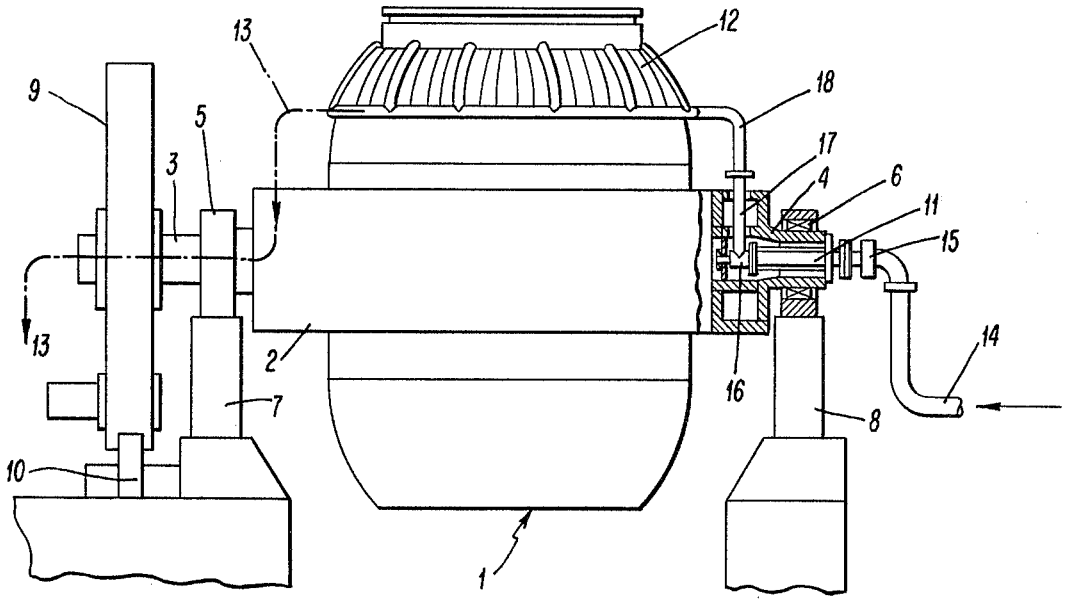
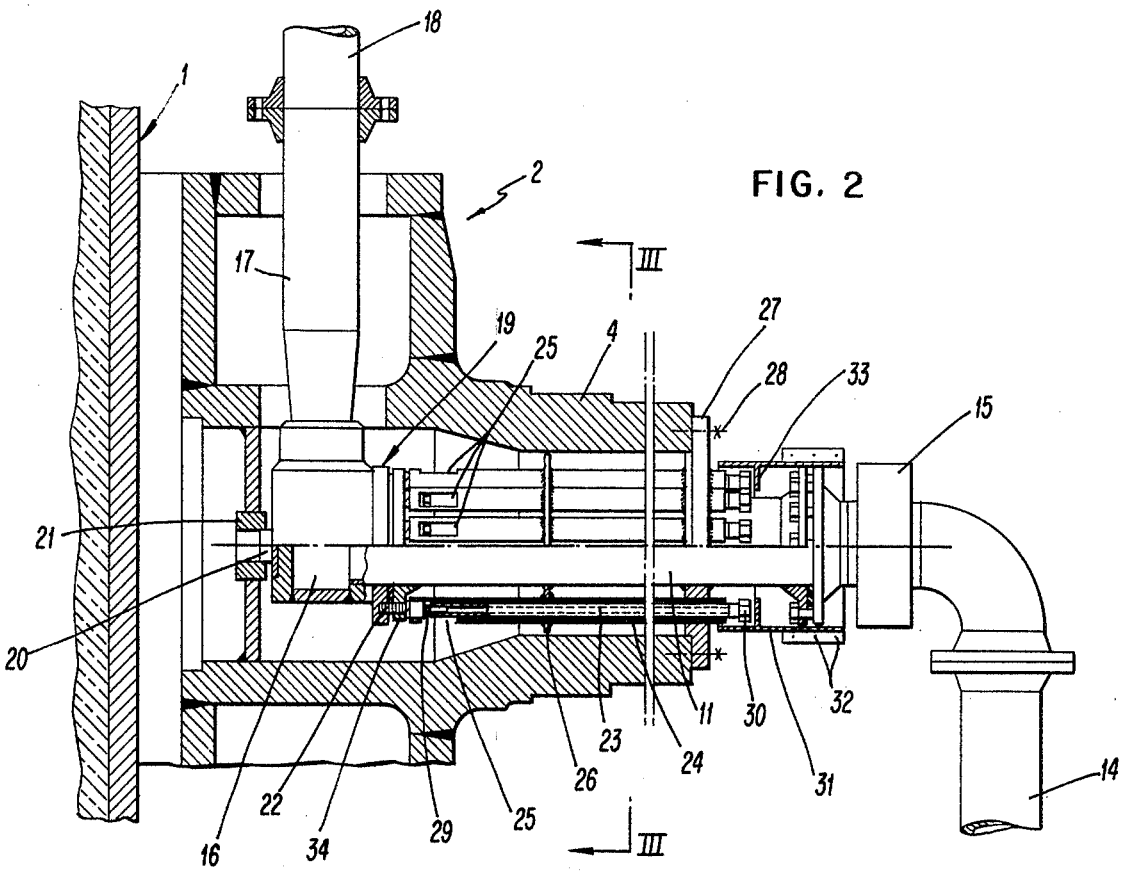
FIG. 2

MEDIUM-CONDUIT-SYSTEM TO BE USED IN TILTABLE-METALLURGICAL-VESSEL-ARRANGEMENT

The invention relates to a device for supplying media, such as for supplying coolants, to a tiltable metallurgical vessel, in particular to a converter of a steel making plant, wherein the vessel is secured in a carrying ring having tilting trunnions and the tilting trunnions are rotatably journaled in bearings supported on the base and at least one of the tilting trunnions has a hollow configuration for accommodating a supply and/or drain pipe for the supply of media.

It has been known to provide converters with supply and drain pipes for the supply of media, which pipes have been guided axially from a rotatable connection through a tilting trunnion. Thereby the full rotatability of the converter by one or more rotations is assured. The horizontal supply pipe or conduit leading through the tilting trunnion is provided in one piece in the region of the carrying ring with a supply pipe leg directed to the converter hood, which supply pipe leg emerges at the upper side of the carrying ring. This one-piece pipe knee has to be inserted either from the carrying trunnion or from the carrying ring.

In modern welded carrying ring constructions it is no longer possible for lack of space in the interior of the carrying ring or tilting trunnion, respectively, to introduce such knee-shaped supply pipes through the tilting trunnion and the carrying ring.

The invention has as its object to provide a device of the above defined kind, which makes it possible to supply and drain media through the tilting trunnion also in converters having narrow, non-accessible carrying rings and having a tilting trunnion with a narrow diameter. In particular the tightness of this device up to high pressures it to be assured. Furthermore it is to be possible to provide pipes or conduits for the supply of media having as wide interior cross sections as possible, so that the hollow space of a tilting trunnion can be filled mainly by a supply pipe or conduit.

According to the invention, these objects are achieved in that the pipe or conduit penetrating the hollow tilting trunnion is connected to a further pipe changing the direction and leading through the carrying ring, which further pipe is connected with an open or closed supply conduit system, by means of a flange connection in the interior of the tilting trunnion or of the carrying ring, wherein flange connection screws are provided with extensions projecting outside the tilting trunnion or the carrying ring, respectively.

Suitably, the extensions of the flange connection screws are displaceably arranged in guide pipes secured to the supply pipe to be concentrical to the flange connection screws. In this manner the supply pipe forms a structural unit with the extensions, which is especially easy to install and remove.

According to a preferred embodiment, the guide pipes are provided with recesses in the area of the flange for inserting the flange connection screws.

Furthermore, it is suitable to secure the extensions against an axial displacement by means of a cover plate secured to the supply pipe and contacting the outwardly arranged ends of the extensions with a collar.

For centering the guide pipes on the supply pipe as well as the supply pipe in the tilting trunnion, advantageously the guide pipes are secured to the supply pipe by means of ring discs concentrically surrounding the supply pipe, the guide pipes penetrating the ring discs.

The invention shall now be described by way of an embodiment and with reference to the accompanying drawings, wherein:

FIG. 1 shows a front view of a converter plant, partly in section,

FIG. 2 shows a detail of FIG. 1 on an enlarged scale,

Figure 3:
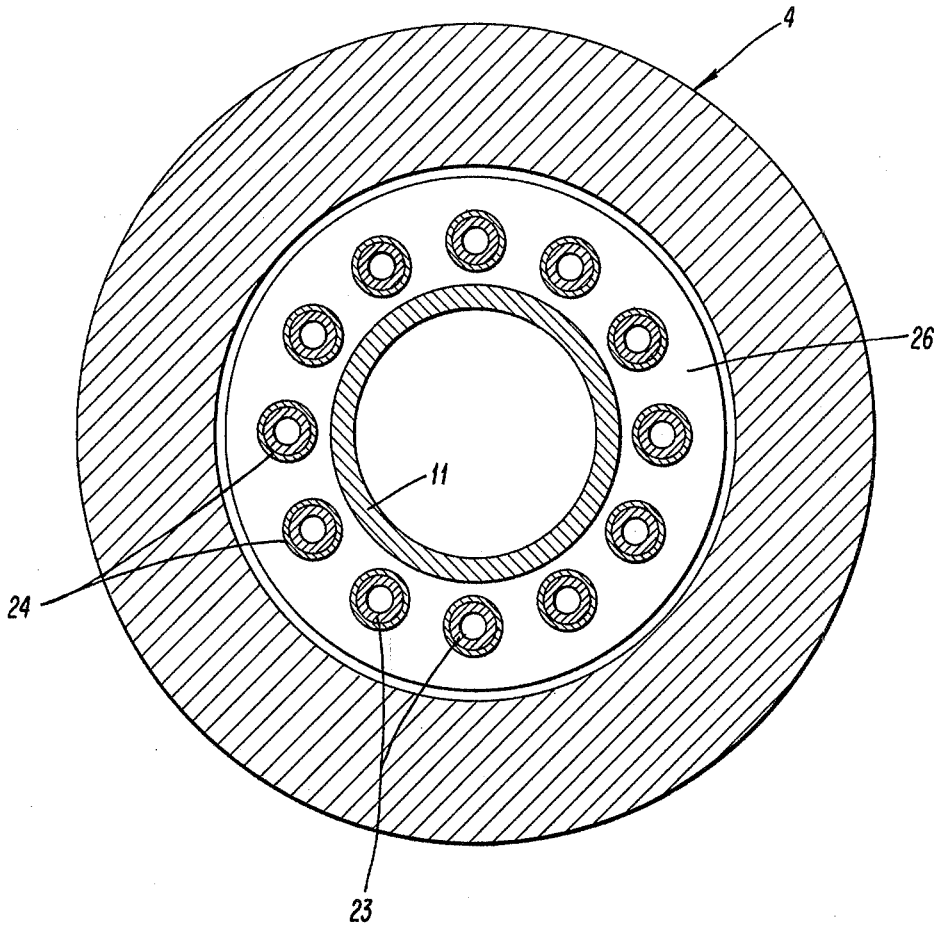
FIG. 3 shows a section along line III—III of FIG. 2.
Figure 4:
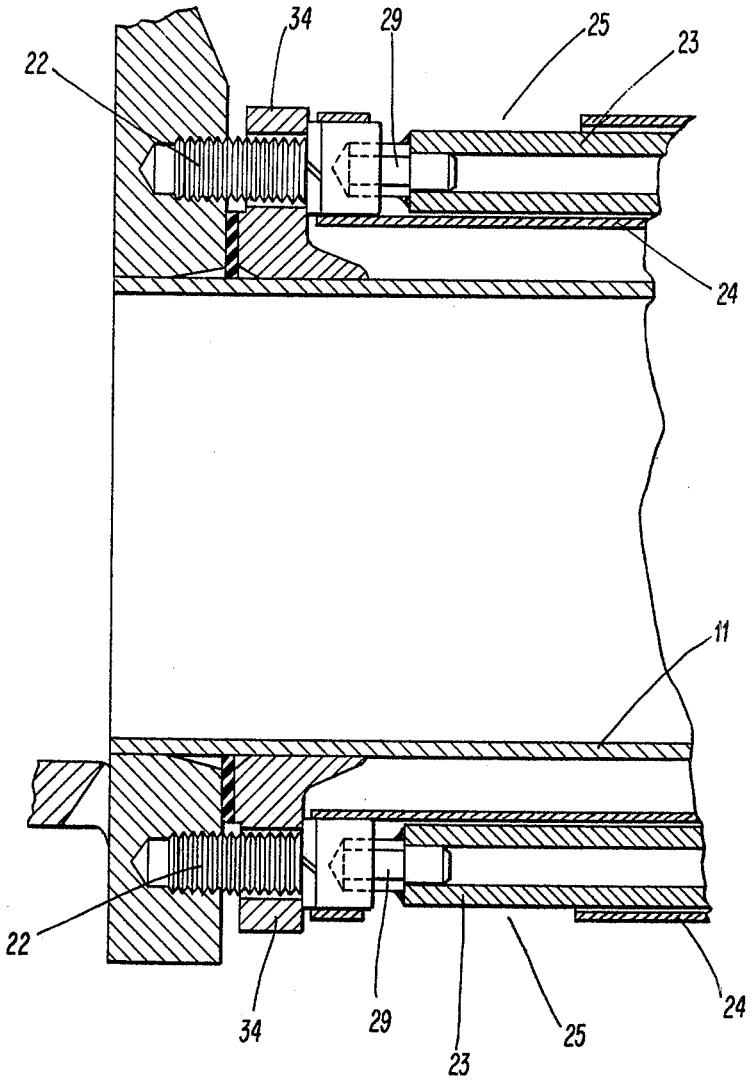
FIG. 4 shows a detail of FIG. 1 on an enlarged scale, depicting more clearly the flange connection screws and their connection with the extension 23.

By 1 a converter is denoted, which is mounted in a carrying ring 2 designed as welding construction. The carrying ring is provided with two oppositely arranged hollow tilting trunnions 3, 4 welded thereinto, one of which is mounted in a fixed bearing 5 and the other one in an expansion bearing 6. The bearings 5, 6 are mounted on the base via supports 7, 8. The fixed bearing pin 3 carries a tilting drive 9 supported on the base via a torque support 10. Through the hollow expansion bearing trunnion 4, a supply pipe 11 for the supply of cooling water for the converter hood colling 12 is inserted. The cooling water is drained through the fixed bearing trunnion, which is also hollow, in the same manner in which it is introduced through the expansion bearing trunnion 4, and this is indicated by arrows 13.

The stationary pipe conduit system 14 is provided with a rotatable connection 15, to which the supply pipe 11 is flanged. A further pipe 17 flanged to the pipe 11 in the interior of the carrying ring 2 with a deflection piece 16 guides the cooling water towards the converter hood; its axis is directed to be approximately perpendicular to the axis of the first supply pipe 11. At the upper side of the carrying ring 2 it extends to the outside and is connected with the converter hood cooling 12 via a pipe piece 18. A flange connection 19 connecting the pipes 11 and 17 assures an absolutely tight sealing also for high pressures. This may be necessary if the pressure prevailing in the converter hood cooling system is a multiple of the pressure common in carrying ring cooling systems. Flaws in the tight sealing then create the danger of an excessive stress for the carrying ring. The deflection piece is provided with a bearing piece 20 screwed thereunto at the side of the vessel, and this bearing piece is mounted in an eye 21 secured in the tilting trunnion 4. This bearing has the purpose of centering the conduits. It allows for a displacement in axial direction of the tilting trunnion caused by a thermal expansion.

Each one of the flange connection screws 22 — arranged around the pipe 11 — of the flange connection 19 is provided with an extension 23 projecting outside the tilting trunnion. These extensions which are designed as shafts that are stiff against torsion are displaceably mounted in guide pipes 24 arranged concentrically to the flange connection screws. In the region of the flange connection 19 the guide pipes 24 are provided with recesses 25 for inserting the flange connection screws 22. The guide pipes are fastened on the supply pipe by means of ring discs 26, 27 concentrically surrounding the supply pipe, which ring discs are penetrated by the guide pipes. Thus the supply pipe forms a structural unit with the guide pipes, which structural unit is precisely aligned in axial direction of the tilting trunnion by the ring discs. The ring disc 27 is secured to the tilting trunnion by screws 28, so that the structural unit supply pipe-guide pipes is fixed on the tilting trunnion. The ring disc 26 is loosely guided in the tilting trunnion for compensating thermal expansions. The heads of the flange connection screws 22 are each provided with an inner hexagon into which the correspondingly designed end 29 of the extensions 23 is insertable. The end 29 may comprise an insert which is affixed, as by welding for example, to a tubular portion of the extension 23. The outwardly projecting end of the extensions is provided with a hexagon 30, and a wrench can be slipped thereunto.

For assembling the flange connection 19 arranged in the interior of the carrying ring, at first the screws 22 have to be inserted in the guide pipes and then they are to be displaced with the extensions 23 towards the counter flange, so that they are secured against falling out. Then the structural unit supply pipe-guiding pipes provided with the inserted screws in introduced into the tilting trunnion until the flanges of the flange connection 19 contact each other with their sealings 34. For precisely centering and aligning the flanges relative to each other, one of the flanges may be provided with a centering pin that is insertable into a corresponding recess of the counter flange. Thereupon the screws 22 are tightened with the help of the extensions 23. Thus it is possible to provide in an easy manner a tight connection of the two pipes 11, 17 in the interior, completely unaccessible region of the carrying ring and tilting trunnion, respectively, which resists even high pressures.

A cover plate 31 can be fastened to the supply pipe 11 by screws 32 to secure the extensions against displacement, and the cover plate rests on the hexagons 30 of the extensions 23 with a radial collar 33.

The device according to the invention can be used for supplying and draining the most diverse media necessary for the operation of a converter. Thus it is possible also to use this device for supplying a lubricant or for supplying refining gases with or without solid particles, e.g. a suspension of powdered lime in oxygen.

What I claim is:

1. In a medium-conduit-system to be used in a tiltable-metallurgical-vessel-arrangement, in particular converter arrangement in a steel making plant, of the type including a carrying ring receiving the vessel therein, tilting trunnions provided on the carrying ring, and base-supported bearings rotatably accommodating the tilting trunnions therein, at least one of the trunnions being hollow to receive a first pipe therein, the improvement which is characterised in that a second pipe is provided to extend through the carrying ring, a first flange is provided on said first pipe and a second flange is provided on said second pipe, said second pipe extends in a direction different from that of said first pipe, flange connection screws are provided to connect said first flange with said second flange thus forming a flange connection, each one of said flange connection screws has an extension projecting to the outside of the metallurgical-vessel-arrangement, and a supply-conduit-system connected to said second pipe.

2. A medium-conduit-system as set forth in claim 1, wherein the flange connection is arranged inside the tilting trunnion and the extension provided on each flange connection screw projects to the outside of the tilting trunnion.

3. A medium-conduit-system as set forth in claim 1, wherein the flange connection is arranged inside the carrying ring and the extension provided on each flange connection screw projects to the outside of the carrying ring.

4. A medium-conduit-system as set forth in claim 1, wherein said medium is a coolant.

5. A medium-conduit-system as set forth in claim 1, wherein said first pipe received in the at least one hollow trunnion is a supply pipe.

6. A medium-conduit-system as set forth in claim 1, wherein said first pipe received in the at least one hollow trunnion is a drain pipe.

7. A medium-conduit-system as set forth in claim 1, wherein said first pipe received in the at least one hollow trunnion is a supply and drain pipe.

8. A medium-conduit-system as set forth in claim 1, wherein the supply-conduit-system connected to said second pipe is an open system.

9. A medium-conduit-system as set forth in claim 1, wherein the supply-conduit-system connected to said second pipe is a closed system.

10. A medium-conduit-system as set forth in claim 1, further comprising guide pipes secured to said first pipe concentrical to said flange connection screws for displaceably accommodating the extension provided on each flange connection screw therein.

11. A medium-conduit-system as set forth in claim 10, wherein the guide pipes are provided with recesses, where the flange connection is, for insertion of the flange connection screws.

12. A medium-conduit-system as set forth in claim 10, further comprising a cover sheet secured to said first pipe and provided with a collar contacting each extension provided for each flange connection screw at the ends of the extensions arranged outside of the metallurgical-vessel-arrangement to thereby secure said extensions against axial displacement.

13. A medium-conduit-system as set forth in claim 10, further comprising ring discs concentrically surrounding the first pipe, the guide pipes penetrating said ring discs and being secured to the first pipe thereby.

* * * * *